US006091038A

United States Patent [19]

Murphy et al.

[11] Patent Number: 6,091,038

[45] Date of Patent: Jul. 18, 2000

[54] ELECTRICAL SWITCH WITH SLIDING TERMINAL CONTACTS

[75] Inventors: Daniel Christopher Murphy, Livonia; Scott Jon Pollock, Ypsilanti, both of Mich.

[73] Assignee: TRW Inc., Lyndhurst, Ohio

[21] Appl. No.: 09/321,383

[22] Filed: May 27, 1999

[51] Int. Cl.[7] ..... H01H 15/02

[52] U.S. Cl. ..... 200/563; 200/253

[58] Field of Search ..... 200/6 R, 6 C, 200/553–557, 560–563, 252, 253, 339

[56] References Cited

U.S. PATENT DOCUMENTS

| | | | |
|---|---|---|---|
| 3,814,871 | 6/1974 | Osika | 200/6 A |
| 3,858,012 | 12/1974 | Lockard | 200/16 D |
| 4,242,551 | 12/1980 | Sorenson | 200/302 |
| 4,705,920 | 11/1987 | Sahrbacker | 200/43.04 |
| 4,725,702 | 2/1988 | Kamisada | 200/254 |
| 4,778,964 | 10/1988 | Kamisada | 200/284 |
| 4,851,619 | 7/1989 | Fujita et al. | 200/6 R |
| 5,598,918 | 2/1997 | Malecke et al. | 200/558 |
| 5,685,419 | 11/1997 | Takano | 200/563 |

*Primary Examiner*—Michael Friedhofer
*Attorney, Agent, or Firm*—Tarolli, Sundheim, Covell, Tummino & Szabo L.L.P.

[57] ABSTRACT

An electrical switch (20) comprises a plastic base (40), a plurality of base terminals (102–112) mounted in the base, a manually pivotable actuator (200) supported for pivotal movement relative to the base, and at least one actuator terminal (260) mounted to the actuator. The actuator (200) is pivotable between a neutral position in which the actuator terminal (260) is in contact with one (106) of the base terminals (102–112) and at least one actuated position in which the actuator terminal is in contact with another (110) of the base terminals. The actuator terminal (260), when the actuator (200) is pivoted from the neutral position to the at least one actuated position, slides out of contact with the one (106) of the base terminals (102–116) and slides into contact with the other (110) of the base terminals. The sliding movement of the actuator terminal (260) into and out of contact with the one (106) of the base terminals (102–112) and the other (110) of the base terminals cleans the actuator terminal and the base terminals to help prevent contamination.

9 Claims, 6 Drawing Sheets

ELECTRICAL SWITCH WITH SLIDING TERMINAL CONTACTS

TECHNICAL FIELD

The present invention relates to an electrical switch with sliding terminal contacts, and is more particularly directed to a double throw vehicle window switch having terminals which slide into and out of contact with each other as a switch actuator is manually pivoted.

BACKGROUND OF THE INVENTION

An electric power window switch is commonly use d to control the energization of an electric motor for opening and closing a vehicle window. The electrical switch is typically located near the associated window and includes a manually engageable actuator which is pivotable in opposite directions to engage and close electrical contacts for energizing the electric motor. To manually control movement of the window, the actuator is pivoted in one direction at a predetermined distance to engage electric al con tacts in the switch. The operator holds the actuator in that position until the window is raised or lowered to a desired level, at which point the operator releases the actuator to stop movement of the window.

One known window switch, commonly referred to as a rocker switch, uses a generally M-shaped movable copper rocker terminal to selectively connect electrical terminals leading to the electric motor depending on the direction in which the actuator is pivoted. The rocker terminal and other terminals in the typical rocker switch are exposed to the environment and thus prone to contamination which can lead to malfunction of the switch and/or part failure.

SUMMARY OF THE INVENTION

The present invention is an electrical switch comprising a plastic base, a plurality of base terminals made of an electrically conductive metal and mounted in the base, a manually pivotable actuator supported for pivotal movement relative to the base about an axis, and at least one actuator terminal made of an electrically conductive metal and mounted to the actuator. The actuator is pivotable between a neutral position in which the at least one actuator terminal is in contact with one of the base terminals and at least one actuated position in which the at least one the actuator terminal is in contact with another of the base terminals. The at least one actuator terminal, when the actuator is pivoted from the neutral position to the at least one actuated position, slides out of contact with the one of the base terminals and slides into contact with the other of the base terminals. The sliding movement of the at least one actuator terminal into and out of contact with the one of the base terminals and the other of the base terminals cleans the at least one actuator terminal and the base terminals to help prevent contamination.

BRIEF DESCRIPTION OF THE DRAWINGS

The foregoing and other features of the present invention will become apparent to those skilled in the art to which the present invention relates upon reading the following description with reference to the accompanying drawings, wherein.

DESCRIPTION OF A PREFERRED EMBODIMENT

Figure 1:
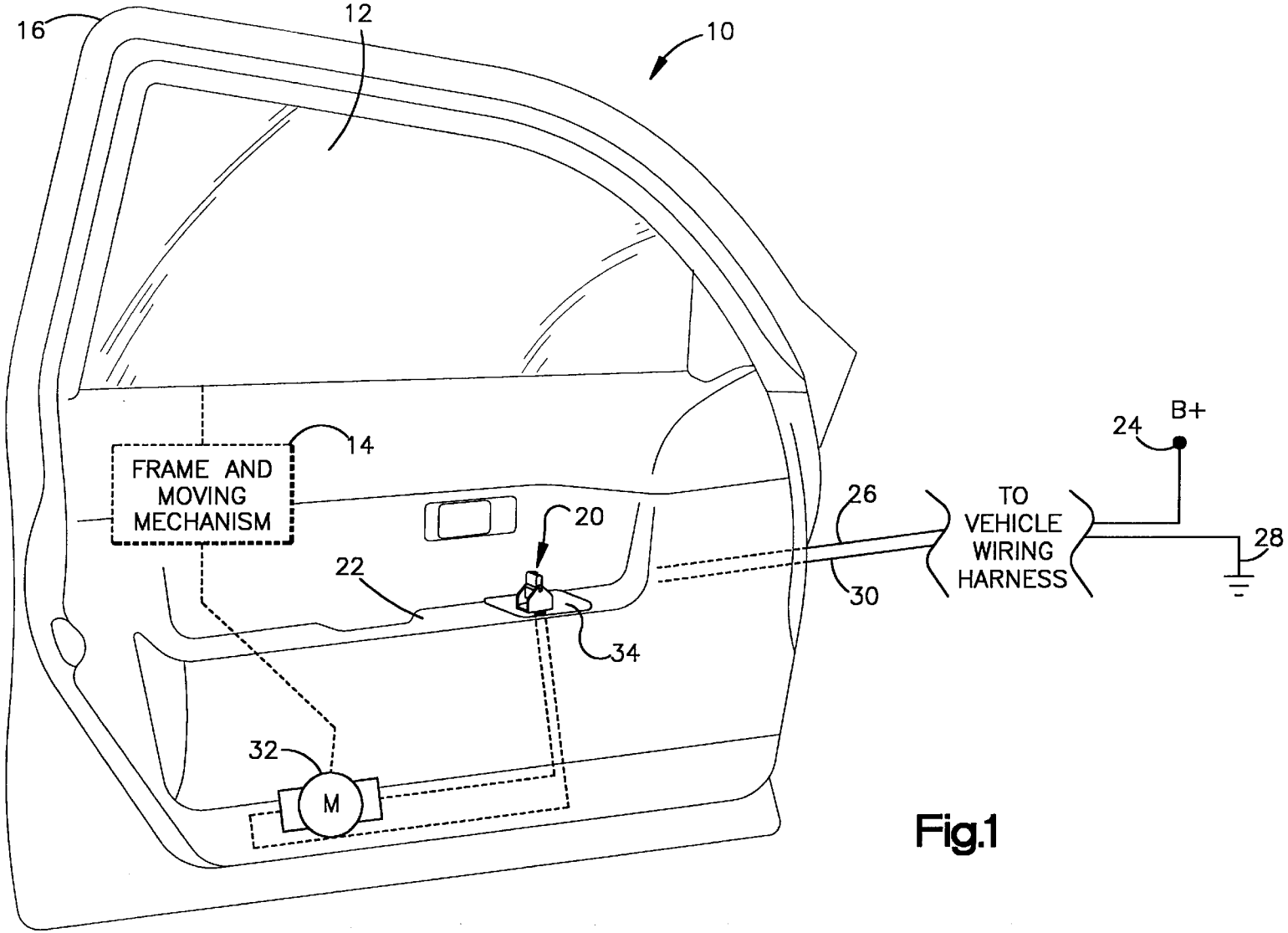
FIG. 1 is a schematic perspective view of a vehicle power window assembly including an electrical switch constructed in accordance with the present invention.

The present invention relates to an electrical switch with sliding terminal contacts, and is more particularly directed to a single pole, double throw vehicle window switch having terminals which slide into and out of contact with each other. As representative of the present invention, FIG. 1 illustrates a vehicle power window system 10 which includes a window 12 mounted in a movable frame and moving mechanism 14 inside of a vehicle door 16. The window 12 slidably moves in opposite directions between a fully opened position and a fully closed position. An electrical switch 20 is mounted in an arm rest 22 on the door 16 and provides a vehicle occupant with the ability to control the position and movement of the window 12.

The electrical switch 20 is-electrically connected to a source of vehicle power 24 (B+) through a conductor 26 and a chassis or frame connection 28 (ground) through another conductor 30. The electrical switch 20 is also electrically connected to a DC motor 32 capable of bi-directional rotation. The electric motor 32 is operatively connected with the frame and moving mechanism 14 supporting the window 12. The motor 32 cooperates with the frame and moving mechanism 14 to move the window 12 between its fully open and fully closed positions when the motor is energized.

Figure 2:
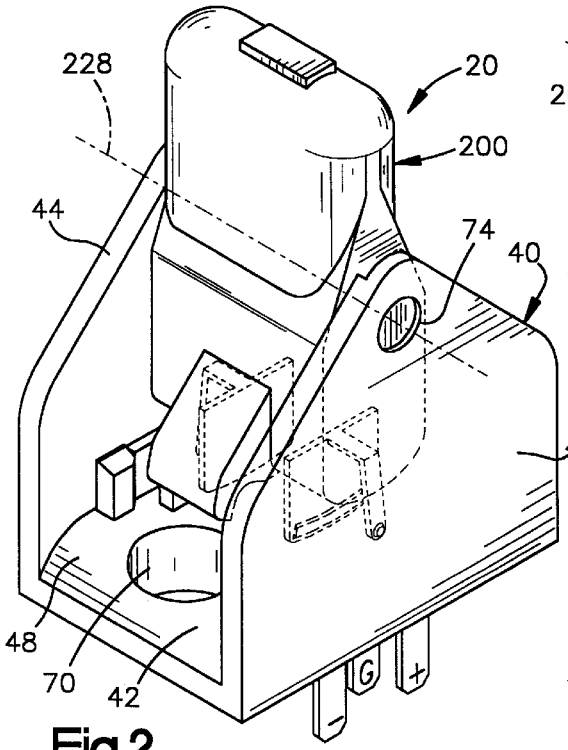
FIG. 2 is a perspective view of the electrical switch of FIG. 1.

In the arm rest 22, the switch 20 is mounted to a printed circuit board 34 in a manner not shown. A plurality of metal pins, which are visible in FIG. 2 and discussed further below, protrude from the bottom of the switch 20 and into corresponding holes (not shown) in the printed circuit board 34. These metal pins are soldered to traces (not shown) which are located on the printed circuit board 34 and which carry electrical signals to and from the switch 20 as is known in the art.

Figure 6:
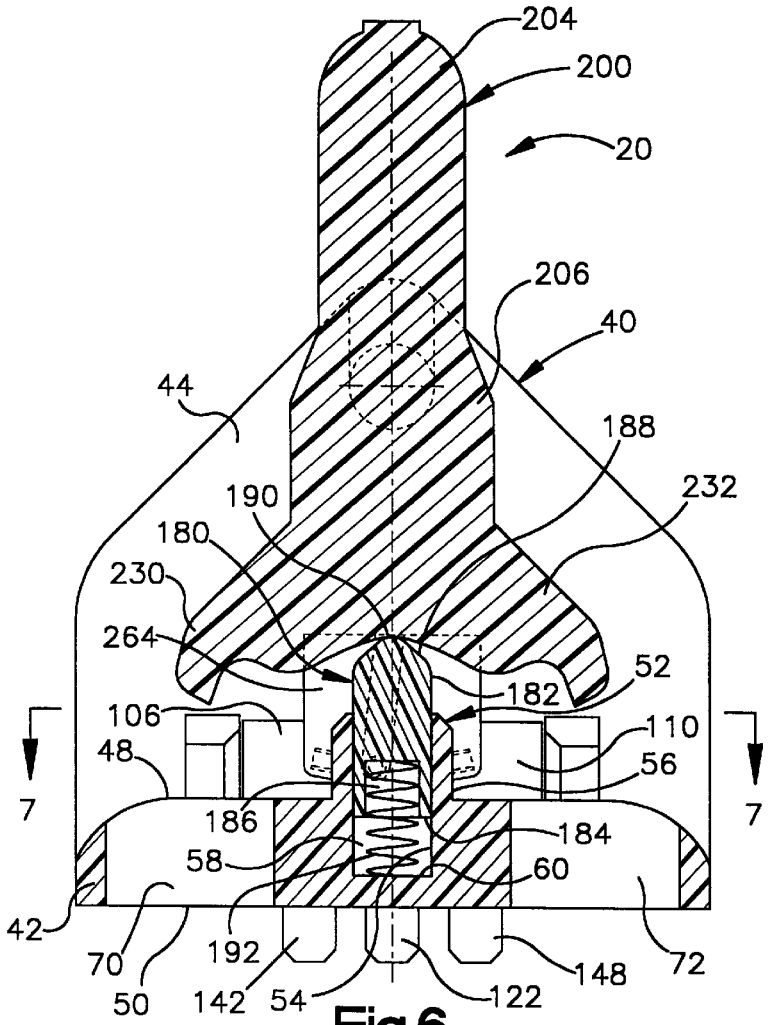
FIG. 6 is a sectional view taken along line 6—6 in FIG. 4.

The switch 20 has a base made of a molded plastic material. The base 40 has a U-shape defined by a base wall 42 and parallel, spaced apart first and second side walls 44 and 46. The base wall 42 has upper and lower surfaces 48 and 50 (FIG. 6). A centrally located plunger support 52 projects upward (as viewed in the Figures) from the upper surface 48 of the base wall 42. The plunger support 52 has a tubular shape defined by cylindrical inner and outer surfaces 54 and 56. The cylindrical inner surface 54 partially defines a plunger chamber 58 within the base 40. One end of the plunger chamber 58 is closed by a planar bottom surface 60 while the other end of the plunger chamber remains open.

The base wall 42 of the base 40 includes a pair of large openings 70 and 72 disposed on opposite sides of the plunger support 56. The large openings 70, 72 extend between the upper and lower surfaces 48 and 50 of the base 40 to allow light from a bulb (not shown) mounted on the printed circuit board 34 to shine through the base wall 42 to illuminate parts of the switch 20.

The first and second side walls 44 and 46 of the base 40 project upward (as viewed in the Figures) from the base wall 42. Each of the side walls 44, 46 has an inverted V-shape and a bearing opening 74 located near the upper tip of the V-shape. The bearing openings 74 lie on a common first axis 76.

Figure 7:
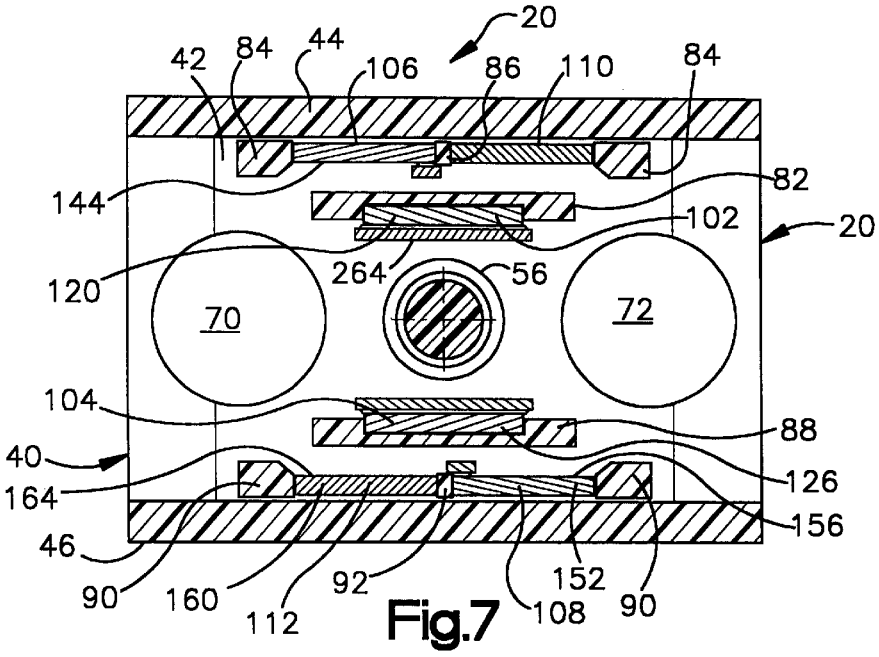
FIG. 7 is a sectional view taken along line 7—7 in FIG. 6.

The base 40 further includes a plurality of base terminal supports (FIG. 7) projecting upward from the base wall 42. The plurality of base terminal supports includes a first ground terminal support 82 located between the plunger support 56 and the first side wall 44. A first pair of spaced apart terminal supports 82 are located adjacent the first side wall 44. A separator support 86 is located midway between the first pair of terminal supports 84. On the opposite side of the base 40, a second ground terminal support 88 is located between the plunger support 56 and the second side wall 46. A second pair of spaced apart terminal supports 90 are located adjacent the second side wall 46. A separator support 92 is located midway between the second pair of terminal supports 90.

A plurality of base terminals made of an electrically conductive material, such as copper, are secured to the base 40. The plurality of base terminals includes first and second ground terminals 102 and 104, first and second positive terminals 106 and 108, and first and second negative terminals 110 and 112. The first ground terminal 102, the first positive terminal 106, and the first negative terminal 110 are disposed between the plunger support 56 and the first side wall 44. The second ground terminal 104, the second positive terminal 108, and the second negative terminal 112 are disposed between the plunger support 56 and the second side wall 46.

The first ground terminal 102 has a T-shape defined by a main portion 120 (FIG. 3) and a pin portion 122 (FIG. 6) extending perpendicular to the main portion. The main portion 120 lies on the upper surface 48 of the base wall 42 of the base 40 and is press fit into a slot (not numbered) in the first ground terminal support 82 (see FIG. 7). The main portion 120 includes a contact surface 124 facing inward toward the plunger support 56. The pin portion 122 extends through an associated opening (not numbered) in the base wall 42 and projects beyond the base 40 as shown in FIG. 6.

The second ground terminal 104 (FIG. 7) is identical to the first ground terminal 102 and has a T-shape defined by a main portion 126 and a pin portion 128 (FIG. 3) extending perpendicular to the main portion. The main portion 126 lies on the upper surface 48 of the base wall 42 of the base 40 and is press fit into a slot (not numbered) in the second ground terminal support 88. The main portion 126 includes a contact surface 130 (FIG. 9) facing inward toward the plunger support 56. The pin portion 128 extends through an associated opening (not numbered) in the base wall 42 and projects beyond the base 40.

Figure 5:
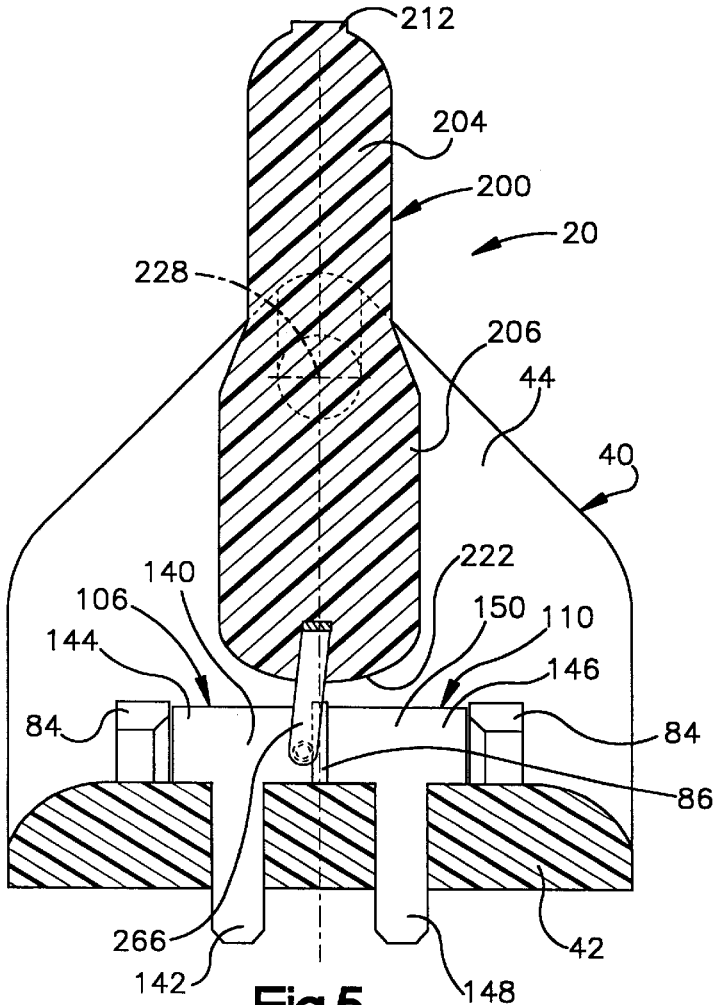
FIG. 5 is a sectional view taken along line 5—5 in FIG. 4.

The first positive and first negative terminals 106 and 110 (FIG. 5) are disposed in an end-to-end relationship between the first pair of terminals supports 84. The separator support 86 separates the first positive and first negative terminals 106 and 110. The first positive terminal 106 has a T-shape defined by a main portion 140 and a pin portion 142 extending perpendicular to the main portion. The main portion 140 lies on the upper surface 48 of the base wall 42 of the base 40 and is press fit between one of the first pair of terminal supports 84 and the separator support 86. The main portion 140 includes a contact surface 144 facing inward toward the plunger support 56. The pin portion 142 extends through an associated opening (not numbered) in the base wall 42 and projects beyond the base 40 as shown in FIG. 5.

The first negative terminal 110 has a T-shape defined by a main portion 146 and a pin portion 148 extending perpendicular to the main portion. The main portion 146 lies on the upper surface 48 of the base wall 42 of the base 40 and is press fit between the other of the first pair of terminal supports 84 and the separator support 86. The main portion 146 includes a contact surface 150 facing inward toward the plunger support 56. The pin portion 148 extends through an associated opening (not numbered) in the base wall 42 and projects beyond the base 40.

The second positive and second negative terminals 108 and 112 (FIG. 7) are disposed in an end-to-end relationship between the second pair of terminals supports 90. The separator support 92 separates the second positive and second negative terminals 108 and 112. The second positive terminal 108 and second negative terminal 112 are oriented in a reverse relationship relative to the orientation of the first positive and first negative terminals 106 and 110, respectively, as may be seen in FIG. 7.

Figure 3:
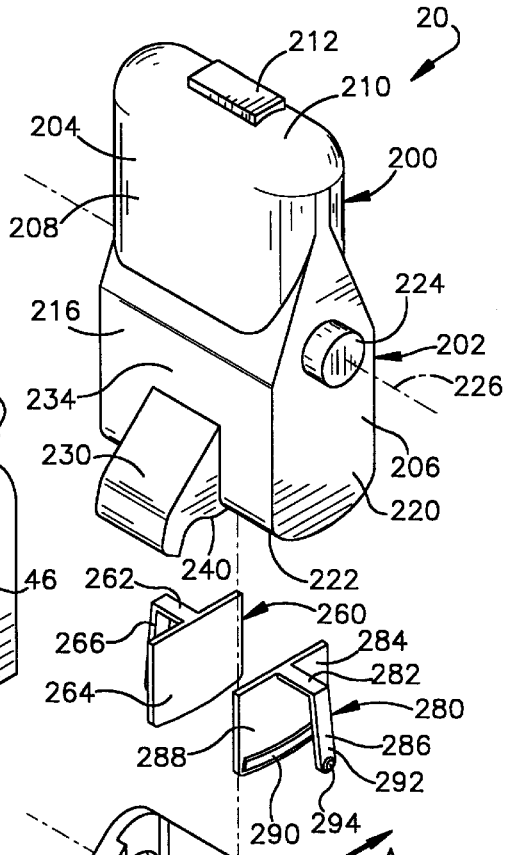
FIG. 3 is an exploded perspective view of the window switch of FIG. 1.
Figure 3:
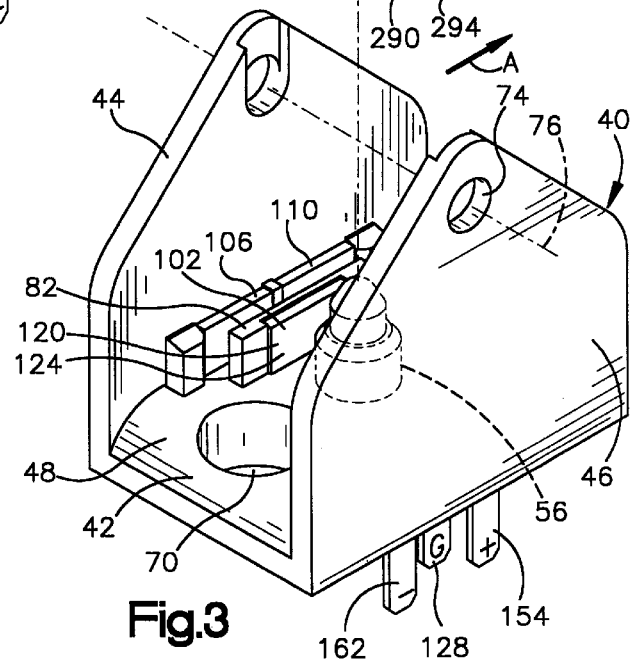
Figure 4:
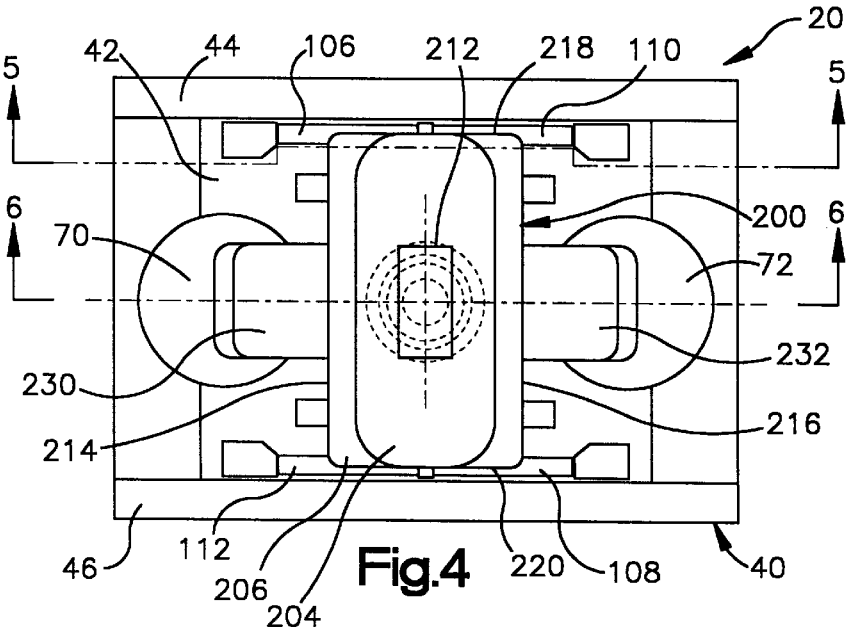
FIG. 4 is a top view of the window switch of FIG. 1 with the switch being shown in a neutral position.

The second positive terminal 108 has a T-shape defined by a main portion 152 and a pin portion 154 (FIG. 3) extending perpendicular to the main portion. The main portion 152 lies on the upper surface 48 of the base wall 42 of the base 40 and is press fit between one of the second pair of terminal supports 90 and the separator support 92. The main portion 152 includes a contact surface 156 facing inward toward the plunger support 56. The pin portion 154 extends through an associated opening (not numbered) in the base wall 42 and projects beyond the base 40 as shown in FIG. 3.

The second negative terminal 112 has a T-shape defined by a main portion 160 (FIG. 7) and a pin portion 162 (FIG. 3) extending perpendicular to the main portion. The main portion 160 lies on the upper surface 48 of the base wall 42 of the base 40 and is press fit between the other of the second pair of terminal supports 90 and the separator support 92. The main portion 160 includes a contact surface 164 facing inward toward the plunger support 56. The pin portion 162 extends through an associated opening (not numbered) in the base wall 42 and projects beyond the base 40.

The electrical switch 20 includes a plunger 180 (FIG. 6) disposed in the plunger chamber 58 in the base 40. The plunger 180 is made of a plastic material and has a cylindrical outer surface 182. The plunger 180 has a planar first end surface 184 facing. toward the bottom surface 60 of the plunger chamber 58. A cylindrical cavity 186 is formed in the first end surface 184. The plunger 80 has a second end surface 188 which is conical and has a rounded tip 190.

A metal spring 192 is also disposed in the plunger chamber 58 in the base 40. One end of the spring 192 engages the bottom surface 60 of the plunger chamber 58 and the other end of the spring is received in the cavity 186 in the first end surface 184 of the plunger 180. The spring 192 biases the plunger 180 away from the base wall 42 of the base 40.

The switch 20 further includes a manually pivotable actuator 200 (FIG. 3) made of plastic. The actuator 200 may be made of a single homogeneous piece of plastic, or from multiple pieces of plastic material which are snapped together. One or more of such plastic pieces may be made of a transparent light conducting polymer.

The actuator 200 has a body portion 202 comprising first and second sections 204 and 206, respectively. The first section 204 is the manually engageable section of the actuator 200 and is disposed above (as viewed in the Figures) the second section 206. The first section 204 has an oval shape with a rounded side edge 208 and a rounded upper edge 210. An illuminated rectangular window 212 may be located in the upper edge 210 to provide additional grip for the occupant.

The second section 206 of the body portion 202 of the actuator 200 has oppositely disposed first and second side surfaces 214 and 216, and oppositely disposed first and second end surfaces 218 and 220. The second section 206 further includes a bottom surface 222 (FIG. 5) facing toward the upper surface 48 of the base wall 42. A cylindrical projection 224 (FIG. 3) extends from each of the end surfaces 218 and 220. The cylindrical projections 224 lie on a common second axis 226. The projections 224 are adapted to be received in the bearing openings 74 in the side walls 44 and 46 of the base 40 whereupon the first and second axes 76 and 226 coincide and define a pivot axis 228 (FIG. 2) about which the actuator 200 is pivotable.

The actuator 200 has first and second wing portions 230 and 232 extending from a middle portion 234 of the second section 206. The first wing portion 230 extends from the first side surface 216 and the second wing portion 232 extends from the second side surface 218. An undulating or contoured surface 240 extends along the underside of the first wing portion 230 to the underside of the second wing portion 232 on the bottom of the second section 206 of the actuator 200. The contoured surface 240 faces downward (as viewed in the Figures) toward the base wall 42 of the base 40 and is engaged by the rounded tip 190 on the second end surface 188 of the plunger 180. The contoured surface 240 includes a centrally located recess 242, first and second detents 244 and 246, and first and second side recesses 248 and 250. The first recess 248 is located in the first wing portion 230 and the second recess 250 is located in the second wing portion 232. The first detent 244 of the contoured surface 240 is disposed between the central recess 242 and the first side recess 248. The second detent 246 is disposed between the central recess 242 and the second side recess 250.

The actuator 200 further includes first and second actuator terminals 260 and 280 (FIG. 3) extending from the bottom surface 222 of the second section 206 in a manner not shown. The actuator terminals 260 and 280 are made of an electrically conductive metal such as copper. The first actuator terminal 260 is located between the contoured surface 240 and the first end surface 218 of the second section 206 of the actuator 200. The second actuator terminal 280 is located between the contoured surface 240 and the second end surface 220 of the second section 206 of the actuator 200.

The first actuator terminal 260 has a U-shape when viewed from the open sides of the base 40. The first actuator terminal 260 is defined by a base portion 262, which extends parallel to the bottom surface 222 of the actuator 200, and first and second portions 264 and 266, project downward (as viewed in the Figures) away from the base portion. The first and second portions 264 and 266 are parallel to one another and spaced apart. The first portion 264 is substantially longer, in a transverse direction A, than the second portion 266. The first portion 264 includes a contact surface 268 (FIG. 9) having a transversely extending, elevated contact ridge 270 facing toward, and in permanent electrical contact with, the contact surface 124 on the first ground terminal 102. The second portion 266 includes a contact surface 272 having an elevated contact point 274 facing toward, and electrically contacting one of the other of the contact surfaces 144 and 150 on, the first positive and first negative terminals 106 and 110, respectively.

The second actuator terminal 280 (FIG. 3) has a U-shape when viewed from the open sides of the base 40. The second actuator terminal 280 is defined by a base portion 282, which extends parallel to the bottom surface 222 of the actuator 200, and first and second portions 284 and 286, which project downward (as viewed in the Figures) away from the base portion. The first and second portions 284 and 286 are parallel to one another and spaced apart. The first portion 284 is substantially longer in the transverse direction A than the second portion 286. The first portion 284 includes a contact surface 288 having a transversely extending, elevated contact ridge 290 facing toward, and in permanent electrical contact with, the contact surface 130 on the second ground terminal 104. The second portion 286 includes a contact surface 292 having an elevated contact point 294 facing toward, and electrically contacting one of the other of the contact surfaces 156 and 164 on, the second positive and second negative terminals 108 and 112, respectively.

FIGS. 4–7 illustrate the electrical switch 20 in a normal, unactuated, neutral position. The switch 20 remains in the neutral position unless and until a vehicle occupant manually engages and pivots the actuator 200. The switch 20 is maintained in the neutral position by the spring-biased plunger 180, the tip 190 of which is disposed in the central recess 242 of the contoured surface 240. In the neutral position, the contact ridge 270 on the first portion 264 of the first actuator terminal 260 is in contact with the contact surface 124 on the first ground terminal 102, while the contact point 274 on the second portion 266 is in contact with the contact surface 144 on the first positive terminal 106. Similarly, in the neutral position, the contact ridge 290 on the first portion 288 of the second actuator terminal 280 is in contact with the contact surface 130 on the second ground terminal 104, while the contact point 294 on the second portion 286 is in contact with the contact surface 156 on the second positive terminal 108. In the neutral position, no current is passed through the switch 20 to energize the electric motor 32.

Figure 8:
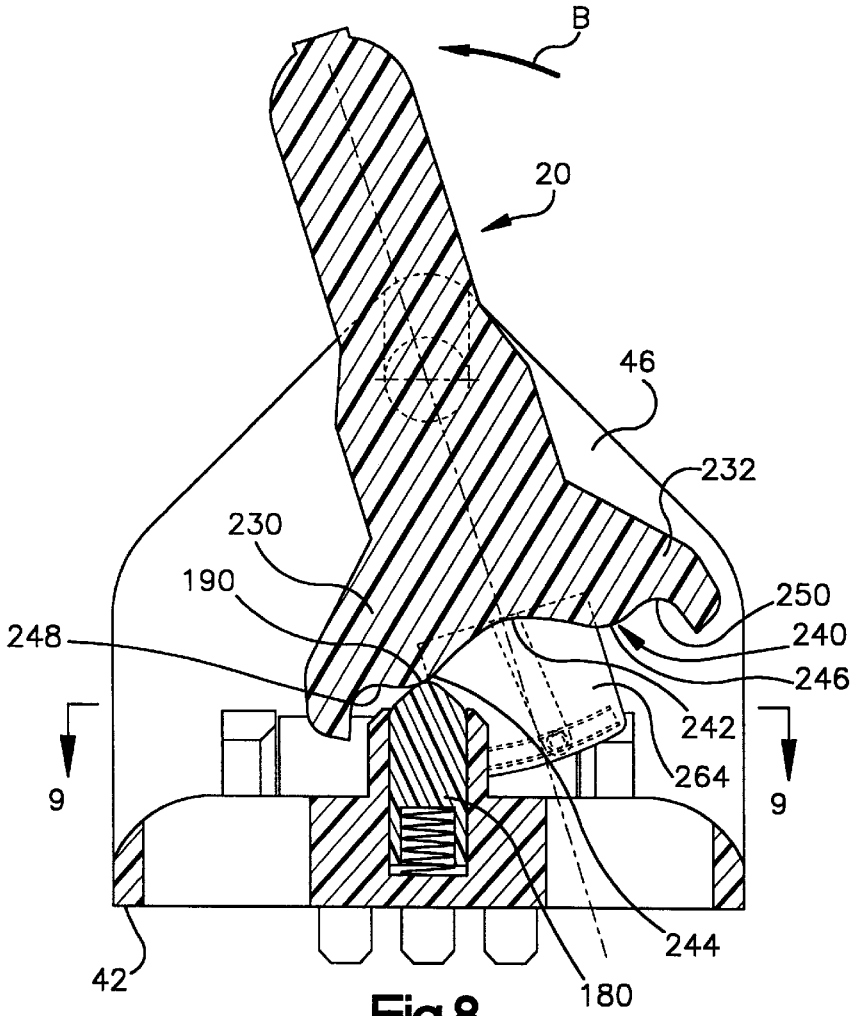
FIG. 8 is a view similar to FIG. 6 with the switch being shown in a first actuated position.
Figure 9:
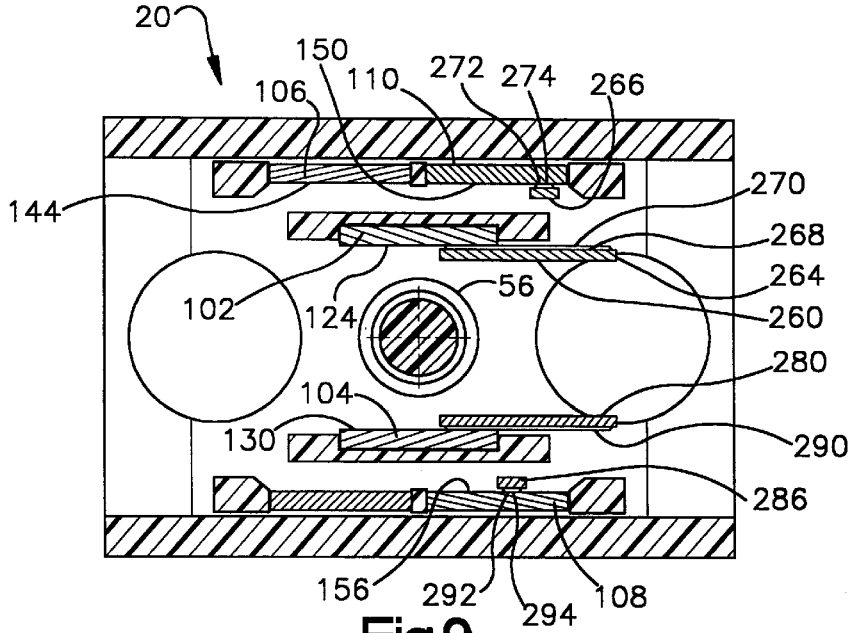
FIG. 9 is a sectional view taken along line 9—9 in FIG. 8.

FIGS. 8 and 9 illustrate the switch 20 in a first actuated position caused by pivotal rotation of the actuator 200 in a first direction B about the pivot axis 228. The actuator 200 is manually pivoted by a vehicle occupant. The pivotal movement is opposed by the spring-biased plunger 180 which is forced downward, as viewed in the Figures, into the plunger chamber 58 as the tip 190 of the plunger rides up onto the first detent 244 on the contoured surface 240. Further, the pivotal movement of the actuator 200 slides the first and second actuator terminals 260 and 280 across the contact surfaces of the plurality of base terminals 102–112 in the base 40. This sliding or wiping motion cleans the contact surfaces of the actuator terminals 260, 280 and the base terminals 102–112 and helps to prevent contamination of these surfaces.

In the first actuated position of FIG. 9, the contact ridge 290 on the first portion 288 of the second actuator terminal 280 remains in contact with the contact surface 130 on the second ground terminal 104, and the contact point 294 on the second portion 286 remains in contact with the contact surface 156 on the second positive terminal 108. The contact ridge 270 on the first portion 264 of the first actuator terminal 260 also remains in contact with the contact surface 124 on the first ground terminal 102. However, the contact point 274 on the second portion 266 of the first actuator terminal 260 slides out of contact with the contact surface 144 on the first positive terminal 106 and into contact with the contact surface 150 of the first negative terminal 110. In this position, an electrical circuit is completed by the switch 20, causing the electric motor 32 to be energized for rotation in one direction. When the actuator 200 is released by the vehicle occupant, the cooperation of the spring-biased plunger 180 and the contoured surface 240 returns the switch 20 to the neutral position.

Figure 10:
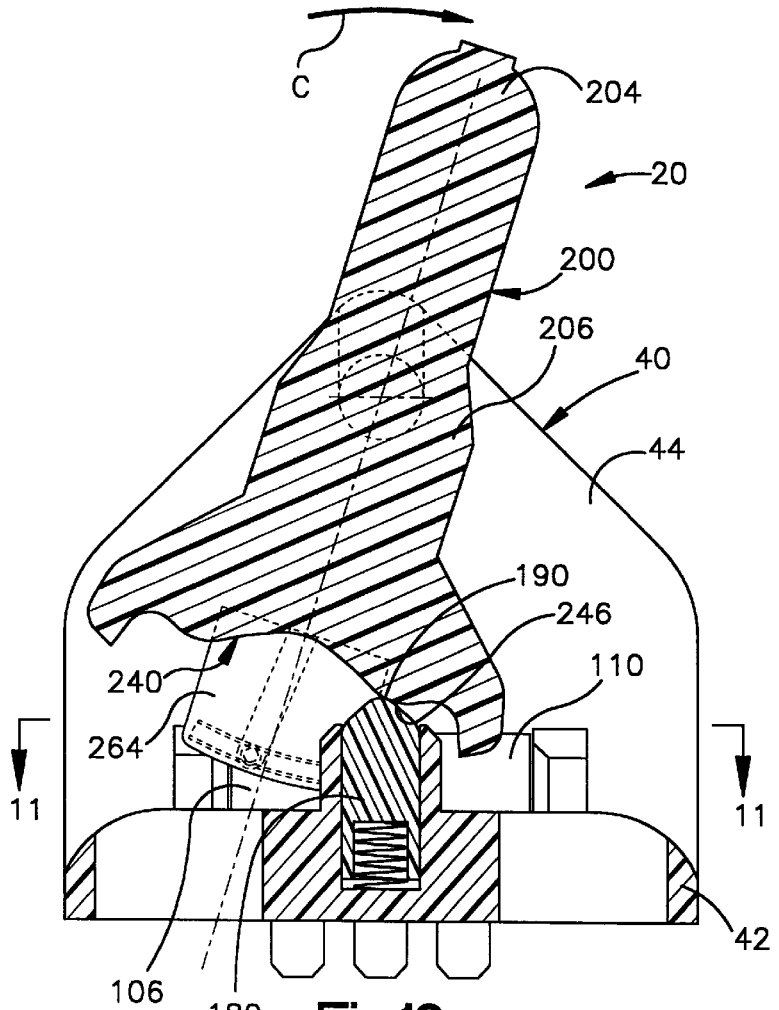
FIG. 10 is a view similar to FIG. 6 with the switch being shown in a second actuated position.
Figure 11:
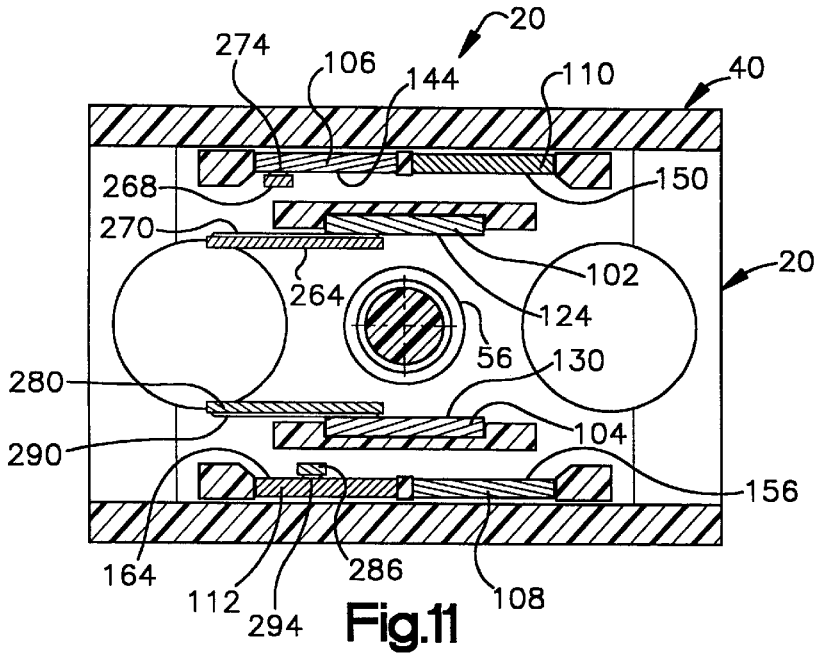
FIG. 11 is a sectional view taken along line 11—11 in FIG. 10.

FIGS. 10 and 11 illustrate the switch 20 in a second actuated position caused by pivotal rotation of the actuator 200 in a second direction C, opposite the first direction B, about the pivot axis 228. The pivotal movement is opposed by the spring-biased plunger 180 which is forced downward, as viewed in the Figures, into the plunger chamber 58 as the tip 190 of the plunger rides up onto the second detent 246 on the contoured surface 240. The pivotal movement of the actuator 200 in the second direction C slides the first and second actuator terminals 260 and 280 across the contact surfaces of the plurality of base terminals 102–112 in the base 40. As stated above, the sliding or wiping motion cleans the contact surfaces of the actuator terminals 260 and 280 and the base terminals 102–112 and helps to prevent contamination of these surfaces.

In the second actuated position of FIG. 11, the contact ridge 270 on the first portion 264 of the first actuator terminal 260 remains in contact with the contact surface 124 on the first ground terminal 102, and the contact point 274 on the second portion 266 remains in contact with the contact surface 144 on the first positive terminal 106. The contact ridge 290 on the first portion 288 of the second actuator terminal 280 also remains in contact with the contact surface 130 on the second ground terminal 104. However, the contact point 294 on the second portion 286 of the second actuator terminal 280 slides out of contact with the contact surface 156 on the second positive terminal 108 and into contact with the contact surface 164 on the second negative terminal 112. In this position, an electrical circuit is completed by the switch 20, causing the electric motor 32 to be energized for rotation in an opposite direction. When the actuator 200 is released by the vehicle occupant, the cooperation of the spring-biased plunger 180 and the contoured surface 240 returns the switch 20 to the neutral position.

The electrical switch 20 disclosed above reduces the possibility of contact contamination due to its sliding contact configuration. A further advantage of the electrical switch 20 according to the present invention is that the electrical contacts are structurally independent from the pivot mechanism. Further, with minimal design modifications to the contoured surface 240, the switch 20 could also include latching or momentary-type features. Additional changes to the contoured surface 240 can adjust the range of rotational travel of the actuator 200 in the switch 20 between 4 and 25 degrees in each direction. The switch 20 disclosed herein can be used in both high or low current applications, and is designed to be illuminated. Due to the relatively small number of parts used in the switch 20, the switch is simple to assemble and inexpensive to produce.

From the above description of the invention, those skilled in the art will perceive improvements, changes and modifications. Such improvements, changes and modifications within the skill of the art are intended to be covered by the appended claims.

Having described the invention, we claim:

1. An electrical switch comprising:

a plastic base;

a plurality of base terminals made of an electrically conductive metal and mounted in said base;

a manually pivotable actuator supported for pivotal movement relative to said base about an axis; and at least one actuator terminal made of an electrically conductive metal and mounted to said actuator;

said actuator being pivotable between a neutral position in which said at least one actuator terminal is in contact with one of said base terminals and two actuated positions in which said at least one actuator terminal is in contact with another of said base terminals;

said at least one actuator terminal, when said actuator is pivoted from said neutral position to said two actuated positions, sliding in a plane out of contact with said one of said base terminals and sliding in said plane into contact with said other of said base terminals, wherein the sliding movement of said at least one actuator terminal into and out of contact with said one of said base terminals and said other of said base terminals cleans said at least one actuator terminal and said base terminals to help prevent contamination.

2. The electrical switch of claim 1 wherein said plurality of base terminals includes first and second ground terminals, first and second positive terminals, and first and second negative terminals.

3. The electrical switch of claim 2 wherein said at least one actuator terminal comprises first and second actuator terminals.

4. The electrical switch of claim 3 wherein each of said actuator terminals has a U-shape defined by a base portion which is attached to said actuator and parallel, transversely extending first and second portions which project away from said base portion and said actuator.

5. The electrical switch of claim 4 wherein said first portion of each of said actuator terminals is in constant contact with one of said ground terminals and said second portion of each of said actuator terminals is in contact with one of said positive and negative terminals.

6. The electrical switch of claim 4 wherein said actuator has a first actuated position in which said second portion of said first actuator terminal is in contact with said first negative terminal and said second portion of said second actuator terminal is in contact with said first positive terminal, said actuator having a second actuated position in which said second portion of said first actuator terminal is in contact with said second positive terminal and said second portion of said second actuator terminal is in contact with said second negative terminal.

7. The electrical switch of claim 6 wherein said actuator is pivotable into said first actuated position by pivotal movement in a first direction and is pivotable into said second actuated position by pivotal movement in a second direction opposite said first direction.

8. The electrical switch of claim 1 further comprising means for controlling the pivotal movement of said actuator.

9. The electrical switch of claim 8 wherein said means comprises a contoured surface on said actuator and a plunger movably supported in said base, said plunger being spring-biased into engagement with said contoured surface.

* * * * *